US005958546A

United States Patent [19]

Mardix et al.

[11] Patent Number: 5,958,546

[45] Date of Patent: Sep. 28, 1999

[54] CUSTOM INSOLES

[76] Inventors: Bar-Cochva Mardix, Rehov Ziman 8, Tel Aviv 67458; Yaacov Sadeh, Rehov Bialik 11, Nes Ziona 70400; Yaacov Makover, Rehov Har Amir, Maccabim 71908, all of Israel

[21] Appl. No.: 08/952,473

[22] PCT Filed: Jul. 8, 1996

[86] PCT No.: PCT/IL96/00046

§ 371 Date: Nov. 17, 1997

§ 102(e) Date: Nov. 17, 1997

[87] PCT Pub. No.: WO98/01050

PCT Pub. Date: Jan. 15, 1998

[51] Int. Cl.[6] ..... A43B 7/14

[52] U.S. Cl. ..... 428/71; 36/43; 36/44; 36/93; 36/154; 36/DIG. 2; 264/316; 264/331.11; 428/304.4

[58] Field of Search ..... 36/88, 93, 43, 36/44, 154, DIG. 2; 428/71, 304.4, 319.3; 264/313, 316, 331.11

[56] References Cited

U.S. PATENT DOCUMENTS

| | | | |
|---|---|---|---|
| 2,092,910 | 9/1937 | Daniels | 36/71 |
| 2,546,827 | 3/1951 | Lavinthal | 36/71 |
| 4,185,402 | 1/1980 | Digate | 36/44 |
| 4,459,326 | 7/1984 | Colombo et al. | 427/140 |
| 5,101,580 | 4/1992 | Lyden | 36/93 |
| 5,203,793 | 4/1993 | Lyden | 36/88 |

*Primary Examiner*—Blaine Copenheaver
*Attorney, Agent, or Firm*—Mark M. Friedman

[57] ABSTRACT

A method for producing a custom insole for a foot of a user, the method including the steps of providing a preformed insole precursor, the precursor being constructed of a solid material which is storable in an undeformed state and which is compressible to a deformed configuration under pressure substantially at room temperature and which retains the deformed configuration after removal of the pressure, and pressing the foot on the insole precursor, thereby compressing the insole precursor and forming an insole with a configuration in accordance with the configuration of the foot.

8 Claims, 1 Drawing Sheet

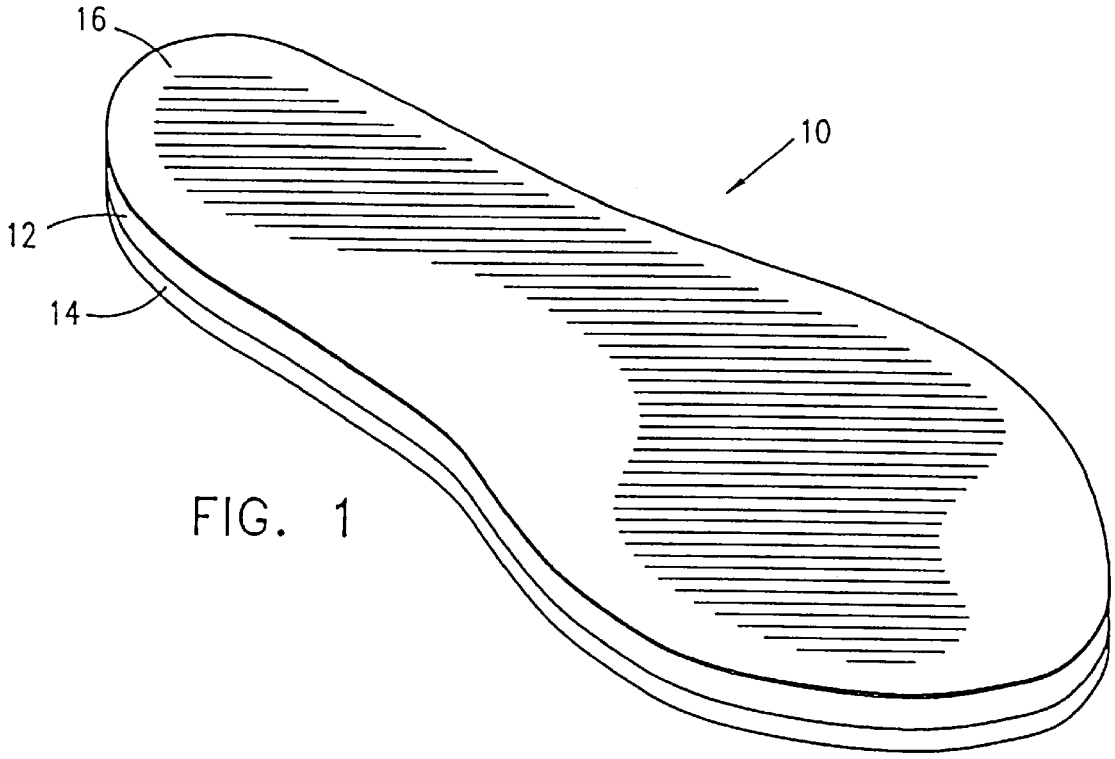
FIG. 1
FIG. 2
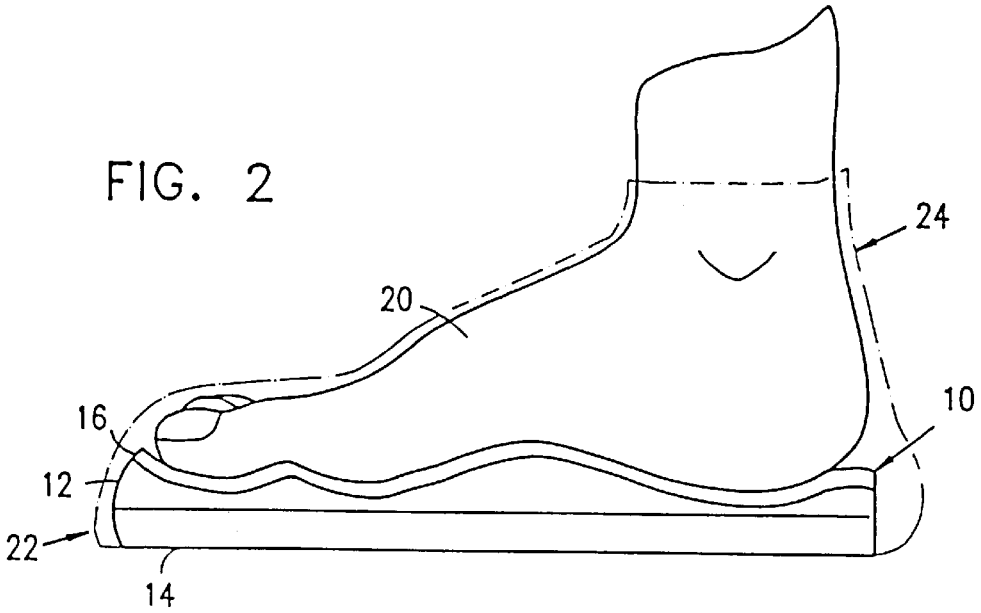

CUSTOM INSOLES

The present invention relates to insoles generally and more particularly to custom insoles which are directly molded by pressure from a user's foot.

Various types of custom insoles are known in the patent literature. It is particularly known to form insoles by pressing a foot of a user on a material which eventually hardens to a conformal shape of the foot.

There are several examples of forming such custom insoles with a two-part curing system. One example is described in U.S. Pat. No. 4,128,951 to Tansill, in which the insole is formed by a two-part elastomeric material. A curable liquid elastomeric material is cured by breaking a compartment which contains a catalyst which mixes with the liquid and cures it to the conformal shape of a foot of a user. A problem of this patent is that it uses a premeasured quantity of curable material and catalyst which may be too much or too little for a particular user, thereby forming inadequate insoles.

Tansill suggested a solution for this problem in U.S. Pat. No. 4,385,024 in which special equipment is used to measure the correct amount of material for a particular foot. However, this method is expensive and time consuming.

In a further patent, U.S. Pat. No. 4,272,898, Tansill describes a shoe insert made of a mass of fibers coated with a curable resin and other fibers which are hollow and contain a curing agent. The hollow fibers are rendered frangible such that the curing agent is uniformly released. However, it is difficult to make the insert structure such that the hollow fibers are uniformly dispersed among the coated fibers. The proposed method of rendering the hollow fibers frangible requires special equipment and treatments.

U.S. Pat. No. 5,095,570 describes making an insole with a material containing an uncured resin which is cured by injecting an activating agent into the resin. This patent suffers from the inconvenience of having to inject the activating agent which requires a special tool, and which does not guarantee that the activating agent will mix properly and uniformly with the resin.

There are other examples in the art of making the insole with a one part system. An example of making such an insole is described in U.S. Pat. No. 3,895,405. The method involves placing a flexible foam insole in a shoe, heating the insole to a temperature sufficient to cause the foam to lose some of its resiliency, placing the foot in the shoe before the insole regains its resiliency, and taking steps with the foot in the shoe until the insole regains its resiliency.

A disadvantage of the '405 patent is that it is difficult to obtain the requisite height of the insole merely by the molding process alone, and additional layers must be added to the insole with subsequent trimming.

In an article entitled "Shoe inserts for small deformed feet", by R. G. S. Platts, S. Knight and I. Jakins, *Prosthetics and Orthotics International*, 1982, Vol. 6, pp. 108–110, a method is described for molding inserts inside the shoe. The method uses a liquid polyurethane foam which has a curing substance pre-mixed with the foam. The foam is poured into a mold in the shoe and quickly hardens to form the insole. However, the method is rather messy, laborious and time-consuming. Uncontrolled pressure created in the shoe during molding may cause a change in foot shape and placement with respect to the shoe.

Thus, there is a need for a one-part system for creating a custom-insole which cures fast, is not messy nor laborious, and which reliably and faithfully reproduces the shape of the user's foot.

The present invention seeks to provide an improved insole precursor which is solid and stable and may be stored indefinitely before being transformed into a custom insole by pressing thereon with a foot of a user. There is no need for adding any activating agent or catalyst. The insole precursor may be placed in a shoe and the user may walk with the shoes for a few hours while the precursor permanently deforms into the custom insole. There is no need for pre-heating the precursor.

Since the precursor only hardens after a few hours, two advantages are realized. First, if the insole is placed in a shoe and offered for sale in a shoe store or orthopedic supply store, the customer may walk in the shoes for a while and then change his mind and not purchase the insole, with the result that the insole substantially returns to its original shape without having been permanently deformed in accordance with that customer's foot. Second, the insole deforms in accordance with the dynamics of the user's foot during walking, unlike some insoles of the prior art which harden only in accordance with the static characteristics of the foot.

There is thus provided in accordance with a preferred embodiment of the present invention, a method for producing a custom insole for a foot of a user, the method including the steps of providing a preformed insole precursor, the precursor being constructed of a solid material which is storable in an undeformed state and which is compressible to a deformed configuration under pressure substantially at room temperature and which retains the deformed configuration after removal of the pressure, and pressing the foot on the insole precursor, thereby compressing the insole precursor and forming an insole with a configuration in accordance with the configuration of the foot. In accordance with a preferred embodiment of the present invention, the method also includes the step of placing the precursor in a shoe prior to pressing the foot on the insole precursor. Preferably the solid material permanently deforms to the deformed configuration after a few hours of applied pressure.

There is also provided in accordance with a preferred embodiment of the present invention, a preformed insole precursor constructed of a solid material which is storable in an undeformed state and which is compressible to a deformed configuration under pressure substantially at room temperature and which retains the deformed configuration after removal of the pressure, the insole precursor being deformable to become a custom insole for a foot of a user by pressing the foot on the insole precursor, thereby compressing the insole precursor and forming an insole with a configuration in accordance with the configuration of the foot.

In accordance with a preferred embodiment of the present invention, the solid material includes a foamed cross-linked ethylene-vinyl acetate copolymer (EVA).

Additionally in accordance with a preferred embodiment of the present invention, the solid material is supported by a layer of a foamed cross-linked polyethylene.

Further in accordance with a preferred embodiment of the present invention, the solid material is covered by a sweat absorbing material.

Alternatively in accordance with another preferred embodiment of the present invention, the solid material includes a polyester foam pre-dipped in a solution including a polyol and an isocyanate dissolved in a trichloroethane. Preferably the solution includes by volume 5% of the polyol, 5% of the isocyanate, and 90% 1,1,1-trichloroethane.

There is also provided in accordance with a preferred embodiment of the present invention, a custom insole for a foot of a user, the insole including a preformed insole precursor, the precursor being constructed of a solid material which is storable in an undeformed state and which is compressible to a deformed configuration under pressure substantially at room temperature and which retains the deformed configuration after removal of the pressure, wherein pressing the foot on the insole precursor compresses the insole precursor, thereby forming the custom insole with a configuration in accordance with the configuration of the foot.

The present invention will be understood and appreciated more fully from the following detailed description, taken in conjunction with the drawings in which:

FIG. 1 is a simplified pictorial illustration of an insole precursor, constructed and operative in accordance with a preferred embodiment of the present invention; and FIG. 2 is a simplified illustration of the transformation of insole precursor into a custom insole, in accordance with a preferred embodiment of the present invention.

Reference is now made to FIG. 1, which illustrates an insole precursor 10, constructed and operative in accordance with a preferred embodiment of the present invention. Insole precursor 10 is preferably formed of a core 12 constructed of a solid material which is storable in an undeformed state and which is compressible to a deformed configuration under pressure substantially at room temperature and which retains the deformed configuration after removal of the pressure. Preferably the solid material permanently deforms to the deformed configuration after a few hours of applied pressure. A preferred material for constructing core 12 which has the aforementioned deforming properties is a foamed cross-linked ethylene-vinyl acetate copolymer (EVA), such as GalFoam GA140 brand name EVA foam, commercially available from Palziv Ltd., Ein Hanatziv, M. P. Emek Beit Shean, Israel.

An alternative material for constructing core 12 is a polyester foam pre-dipped in a solution comprising a polyol and an isocyanate dissolved in a trichloroethane. Preferably the solution comprises by volume 5% polyol Z105A, 5% isocyanate 44V20, both being brand names of and commercially available from Polyurethane Ltd., P.O. Box 1606, Haifa, Israel, and 90% 1,1,1-trichloroethane.

Insole precursor 10 preferably also includes a supporting layer 14 attached beneath core 12, such as by bonding. Supporting layer 14 may be made of a foamed cross-linked polyethylene. Core 12 may be covered by a covering layer 16, preferably made of a sweat absorbing material, such as COOL-MAX brand, commercially available from DuPont.

Reference is now made to FIG. 2 which illustrates transformation of insole precursor 10 into a custom insole. A foot 20 of a user presses on insole precursor 10, thereby compressing insole precursor 10 and forming an insole 22 with a configuration in accordance with the configuration of foot 20. Insole precursor 10 may be placed in a shoe 24 prior to pressing foot 20 on insole precursor 10.

It is appreciated that the insole provided in accordance with the present invention may be constructed to support the entire foot or alternatively only part of the foot, such as the heel, the heel and the arch up to the metatarsal heads or up to the base of the toes.

It will be appreciated by persons skilled in the art that the present invention is not limited by what has been particularly shown and described hereinabove. Rather the scope of the present invention is defined only by the claims which follow:

We claim:

1. A preformed insole precursor constructed of a solid material which is storable in an undeformed state and which is compressible to a deformed configuration under pressure substantially at room temperature and which retains said deformed configuration after removal of said pressure only after having been subjected to said pressure for at least a few hours but without use of any activating agent or catalyst, said insole precursor being deformable to become a custom insole for a foot of a user by pressing said foot on said insole precursor for a few hours, thereby compressing said insole precursor and forming an insole with a configuration in accordance with the configuration of said foot.

2. The insole precursor of claim 1, wherein said solid material includes a foamed cross-linked ethylene-vinyl acetate copolymer (EVA).

3. The insole precursor of claim 1, wherein said solid material is supported by a layer of a foamed cross-linked polyethylene.

4. The insole precursor of claim 1, wherein said solid material is covered by a sweat absorbing material.

5. The insole precursor of claim 1, said solid material includes a polyester foam pre-dipped in a solution including a polyol and an isocyanate dissolved in a trichloroethane.

6. The insole precursor of claim 5, wherein said solution includes by volume 5% of said polyol, 5% of said isocyanate, and 90% 1,1,1-trichloroethane.

7. A method for producing a custom insole for a foot of a user, said method comprising the steps of: providing a preformed insole precursor, said precursor being constructed of a solid material which is storable in an undeformed state and which is compressible to a deformed configuration under pressure applied by the foot for a few hours substantially at room temperature and which retains said deformed configuration after removal of said pressure only after having been subjected to said pressure for at least a few hours but without use of any activating agent or catalyst; and pressing said foot on said insole precursor, thereby compressing said insole precursor and forming an insole with a configuration in accordance with the configuration of said foot.

8. The method of claim 7, further comprising the step of placing said precursor in a shoe prior to pressing said foot on said insole precursor.

* * * * *